US011008681B2

(12) United States Patent
Lawrence

(10) Patent No.: US 11,008,681 B2
(45) Date of Patent: May 18, 2021

(54) DUAL FUNCTION ABSORBING AND COOLING TEXTILE

(71) Applicant: MPUSA, LLC, Brentwood, NH (US)

(72) Inventor: David Chad Lawrence, Alpharetta, GA (US)

(73) Assignee: MPUSA, LLC, Fort Lauderdale, FL (US)

( * ) Notice: Subject to any disclaimer, the term of this patent is extended or adjusted under 35 U.S.C. 154(b) by 0 days.

(21) Appl. No.: 16/481,226

(22) PCT Filed: Jan. 25, 2019

(86) PCT No.: PCT/US2019/015239

§ 371 (c)(1),
(2) Date: Jul. 26, 2019

(87) PCT Pub. No.: WO2019/147997

PCT Pub. Date: Aug. 1, 2019

(65) Prior Publication Data

US 2020/0385901 A1 Dec. 10, 2020

Related U.S. Application Data

(60) Provisional application No. 62/621,851, filed on Jan. 25, 2018, provisional application No. 62/720,483, filed on Aug. 21, 2018.

(51) Int. Cl.

| | |
|---|---|
| ***D04B 21/04*** | (2006.01) |
| ***D04B 21/18*** | (2006.01) |
| ***D04B 21/20*** | (2006.01) |

(52) U.S. Cl.

CPC ..... *D04B 21/04* (2013.01); *D04B 21/18* (2013.01); *D04B 21/207* (2013.01);
(Continued)

(58) Field of Classification Search

CPC ..... D04B 21/04; D04B 21/18; D04B 21/207; D04B 21/16

See application file for complete search history.

(56) References Cited

U.S. PATENT DOCUMENTS 4,823,563 A 4/1989 Wunner
5,817,391 A * 10/1998 Rock ..... A47C 27/006 428/86

(Continued)

FOREIGN PATENT DOCUMENTS

WO 2017/210589 A2 12/2017

OTHER PUBLICATIONS

International Search Report and Written Opinion dated May 10, 2019, from International Application No. PCT/US2019/015239, 14 sheets.

(Continued)

*Primary Examiner* — Danny Worrell
(74) *Attorney, Agent, or Firm* — Carter Deluca & Farrell LLP

(57) ABSTRACT

Disclosed herein is a warp knit spacer dual functional fabric construction that provides the ability to absorb sweat on one side and the ability to cool skin to below a current temperature whether wetted or dry on the other side. The knit uses four separate yarns which collectively work together to produce enhanced cooling. Knits can include warp knit spacer and circular knit spacer materials. Various finishing methods may also be employed to enhance the cooling power of the fabric.

22 Claims, 8 Drawing Sheets

3D Approach

(52) U.S. Cl.
CPC ..... *D10B 2331/02* (2013.01); *D10B 2331/04* (2013.01); *D10B 2401/022* (2013.01); *D10B 2403/0114* (2013.01); *D10B 2403/021* (2013.01); *D10B 2501/00* (2013.01)

(56) References Cited

U.S. PATENT DOCUMENTS

| | | | | |
|---|---|---|---|---|
| 5,896,758 | A * | 4/1999 | Rock | A43B 1/04 66/191 |
| 6,196,032 | B1 | 3/2001 | Rock et al. | |
| 6,634,190 | B2 | 10/2003 | Didier-Laurent | |
| 7,169,720 | B2 * | 1/2007 | Etchells | A43B 1/0045 442/239 |
| 7,465,683 | B2 * | 12/2008 | McMurray | D04B 21/18 442/314 |
| 7,579,045 | B2 * | 8/2009 | Rock | D04B 1/24 427/288 |
| 7,849,715 | B2 * | 12/2010 | Starbuck | A41C 5/00 66/171 |
| 7,926,307 | B1 * | 4/2011 | Williams | D04B 1/02 66/194 |
| 9,657,417 | B2 | 5/2017 | Cabouillet et al. | |
| 9,725,835 | B2 * | 8/2017 | Vaglio Tessitore | D04B 1/16 |
| 9,745,679 | B2 | 8/2017 | Zhang et al. | |
| 2002/0157429 | A1 * | 10/2002 | Matsumoto | D04B 21/10 66/195 |
| 2007/0093162 | A1 * | 4/2007 | Holcombe | D06M 13/02 442/208 |
| 2012/0122365 | A1 * | 5/2012 | Erickson | B32B 7/14 442/312 |
| 2012/0330093 | A1 * | 12/2012 | Odermatt | A61F 2/0063 600/30 |
| 2013/0237109 | A1 * | 9/2013 | Ackroyd | D03D 1/00 442/181 |
| 2018/0338563 | A1 * | 11/2018 | Moretti Polegato | D04B 21/20 |
| 2018/0347084 | A1 * | 12/2018 | Lawrence | D04B 1/16 |

OTHER PUBLICATIONS

European Search Report issued in EP Application No. 19744406.0, dated Feb. 3, 2021, pp. 1-12.

* cited by examiner

BAR 1
1-0 / 1-2

BAR 2
1-0 / 1-2

BAR 3
2-1 / 1-2

BAR 4
1-2 / 1-0

3D Approach

DUAL FUNCTION ABSORBING AND COOLING TEXTILE

CROSS-REFERENCE TO RELATED APPLICATION

The present application claims priority to U.S. Provisional Patent Application Ser. No. 62/621,851, filed Jan. 25, 2018 and U.S. Provisional Patent Application Ser. No. 62/720,483, filed Aug. 21, 2018, the entire contents of which are hereby incorporated by reference in their entirety.

FIELD OF THE INVENTION

The present invention is directed to a knitted textile that provides a dual function two-sided textile capable of absorbing up to four times its weight in perspiration on a loop absorbent side. Also, while wetted to activate, the same textile can provide increased conductive cooling on a non-loop (flat) absorbent side. More particularly, the present invention is directed to a multi-layer warp knit spacer fabric construction that provides the ability to absorb sweat efficiently away from the skin while the same textile can be used to cool the skin to below a current temperature of the skin for a longer duration, primarily when wetted, but secondarily in dry state. Described in this patent application is an integrally formed warp knitted spacer structure comprised of four yarns which collectively work together to produce the textile.

BACKGROUND

Previous wet-activated cooling textiles have used woven and double knit constructions using absorbent yarns that have moisture absorbing properties. A first layer, located next to the skin, provides a sustained cooling effect. However, such fabrics generally quickly dry out and/or warm up to the skin temperature of the user, negating any cooling effect. In addition, these fabrics have limited sweat absorbing capability as they tend to be thinner than a normal terry towel and are not constructed with a loop pile designed to absorb sweat. Therefore, a need exists for a dual function absorbing and cooling textile employing more advanced yarns and construction techniques which alleviates the deficiencies of current cooling textiles.

SUMMARY OF THE INVENTION

The present invention relates generally to textile fabrics and, more particularly, to dual function absorbing and cooling warp knit spacer fabric constructions that provide the ability to absorb sweat on one side of the fabric while also having a cooling side which can cool skin below a current temperature of the skin for a longer duration, primarily when wetted, but secondarily in a dry state.

DETAILED DESCRIPTION

Warp Knit Spacer Construction

Figure 1:
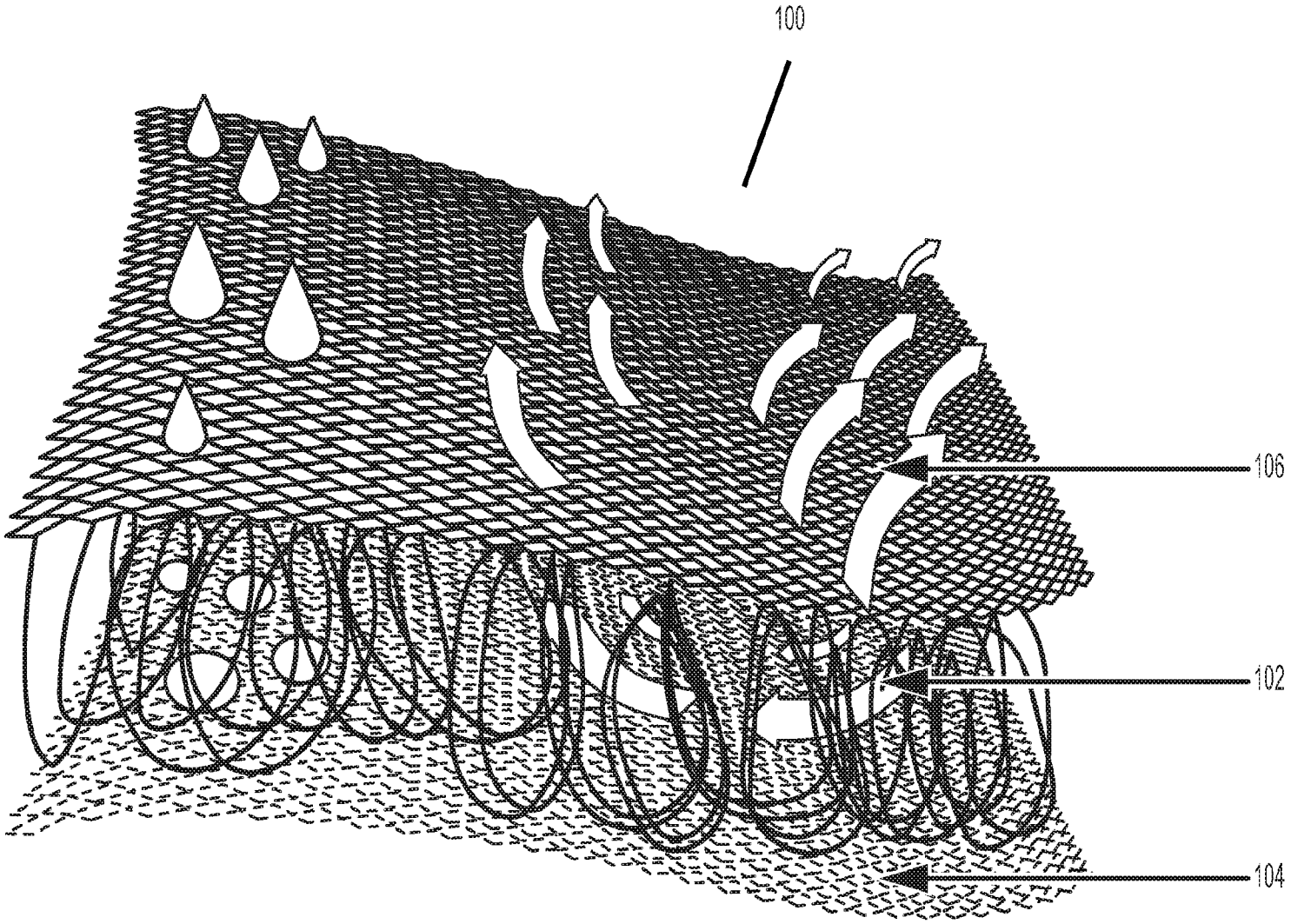
FIG. 1 depicts a representational cross-sectional view of the dual function absorbing and cooling textile showing the different layers of textile.

As shown in FIG. 1, a first side 102 of the dual function absorbing and cooling textile 100, comprises a plurality of loops for absorbing moisture or sweat from skin surface 104. A second side 106 of dual function textile 100 is a cooling side and is preferably flat, especially relative to first side 102. Preferably, the raised loops of first side 102 have a pile height of greater than 0.2 millimeter. The raised loops on first side 102 may be omitted in some sections to accommodate a pattern or other design using the loops. The pile height may also be varied across the surface of first side 102.

Preferably, the second side 106 does not comprise any raised pile. The loop pile height can be altered to other lengths depending on the amount of absorbency, duration, and conductive cooling desired of dual function textile 100. As used here, pile is a fabric effect formed by a plurality of loops (or other erected yarns) extending above the fabric surface. Pile height is the height of the plurality of loops above the fabric surface.

Second side 106, which is opposite first side 102, comprises yarns designed to impart extra evaporative cooling performance, leveraging the heat of evaporation science to impart cooling to consumers.

An embodiment of the dual function textile 100 is intended to be worn next to the skin 104 of a user, such as an athlete. The dual function textile 100 may form an entire garment, such as a shirt or a pair of shorts, or be strategically integrated into garments where extra cooling is needed, such as near the shoulders/underarms of a user. The dual function textile 100 may also be utilized to form standalone cooling products such as headbands, towels, hats, etc.

The evaporative cooling effect of dual function textile 100 is activated when the dual function textile 100 is wetted, wringed, and snapped or twirled in the air. The cooling effect for the dual function textile 100 described in herein utilizes the principles of evaporative cooling (heat of evaporation). This principle details that water must have heat energy applied to change from a liquid into a vapor. Once evaporation occurs, this heat from the liquid water is taken due to evaporation resulting in cooler liquid left in dual function textile 100.

Once dual function textile 100 is wetted and preferably wringed to remove excess water, snapping or twirling in the air is a recommended process as it helps facilitate and expedite the moisture movement from first side 102, where water is stored, to the non-loop second side 106, where greater water evaporation to the environment occurs. Snapping or twirling in the air also increases the evaporation rate and decreases the material temperature more rapidly by exposing more surface area of dual function textile 100 to air and increased airflow. More specifically, the dual function textile 100 works as a device that facilitates and expedites the evaporative process. Methods of make described in this patent have proven to provide additional benefits of cooling over other fabrics.

Once the temperature of the remaining water in the outer evaporative layers (e.g., second side 106) drops through evaporation, a heat exchange happens within water through convection, between water and dual function textile 100 through conduction, and within dual function textile 100 through conduction. Thus, the temperature of dual function textile 100 drops. The evaporation process further continues by wicking water away from the loop side to the non-loop side until the stored water is used up. The evaporation rate decreases as the temperature of material drops. The temperature of dual function textile 100 drops gradually to a certain point where equilibrium is reached between the rate of heat absorption into material from environment and heat release by evaporation.

Once the wetted dual function textile 100 is placed onto a user's skin on second side 106, cooling energy from dual function textile 100 is transferred through conduction from second side 106 to skin surface 104. After the cooling energy transfer has occurred, the temperature of dual function textile 100 increases to equilibrate with the temperature of skin surface 104. Once this occurs, the wetted dual function textile 100 can easily be reactivated by the snapping or the twirling method to again drop the temperature. As previously stated, the methods of making dual function textile 100 described in this patent have proven to provide additional benefits of cooling over previous inventions.

Once the wetted dual function textile 100 is placed, the first side 102 can be used to wipe sweat or moisture from skin surface 104. The user can use dual function textile 100 in this manner until the textile has become completely saturated. Then, to reactivate dual function textile 100, it can be we, wringed, snapped, etc. The user's sweat can even be used to activate dual function textile 100.

To produce the unique cooling effect of dual function textile 100, a warp knit spacer construction is preferably utilized to create a textile having dual functional layers comprising different yarns in the same material. Second side 106 (cooling side) comprising either predominately Polyester or Nylon yarns with an optional modified cross-section yarn imbedded with cooling minerals (or particles) which act to transport and evaporate moisture while providing a cool touch. The opposite side, first side 102 (absorbing side), comprises either predominately Polyester and Nylon yarn designed with special absorbing yarns which enables the textile to have increased capability to absorb, transport, and retain moisture.

Dual function textile 100 also preferably comprises an elastomeric yarn, such as spandex, that provides dual function textile 100 with improved drape and stretch properties. The elastomeric yarn also provides hydrophobic properties to allow moisture to quickly dissipate to the more absorbent and evaporative yarns in dual function textile 100. The intended end-use of dual function textile 100 provides a dual cooling and absorption of sweat from activities such as participating in sports, sporting events, leisure events, or "do-it-yourself" work around the house. Dual function textile 100 can be used for any occasion where one wants to stay cool while in the heat.

Dual function cooling and absorbing textile is unique in the ability to have the dual purpose of absorbing and cooling all in the same material. Dual function textile 100 can therefore be used in the accessory and/or the apparel industry to provide a dual purpose of absorbing and conductive cooling with increased amount of absorbency and cooling power over current options in the market.

Figure 2A:
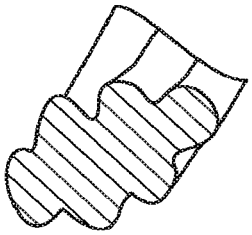
FIGS. 2A-2D depict cross sectional views of yarn filaments that may be used in construction of the dual function absorbing and cooling fabric.
Figure 2B:
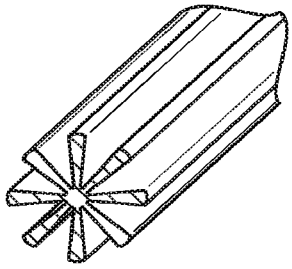
Figure 2C:
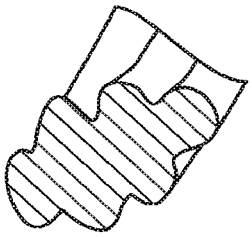
Figure 2D:
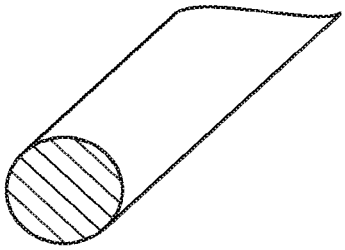

FIGS. 2A-2D depict cross-sectional views of yarn filaments which can be utilized in the construction of dual function textile 100. A cross-section of a single filament of a stretchable synthetic (elastomeric) yarn, such as spandex, is depicted in FIG. 2D. As will be described later, an elastomeric yarn is generally utilized on Bar 4 during construction and provides dual function textile 100 with drape and stretch properties.

The other Bars (e.g., 1-3) may utilize a variety of other yarns. FIGS. 2A and 2C depict a nylon or polyester (evaporative) yarn having a unique cross-section which may be embedded with minerals or particles (e.g., jade or mica) to transport and evaporate moisture from skin surface 104 while still providing conductive cooling and a cool touch. Examples of suitable evaporative yarns with such a cross-section include MIPAN AQUA-X and ASKIN, both manufactured by Hyosung Corporation of the Republic of Korea, both of which also provide UV protection.

FIG. 2B depicts a cross-section of a conjugated bi-component polyester and nylon (absorbent) yarn with a special star-shaped cross-section (the star-shaped cross-section is formed as the result of a treatment applied after dual function textile 100 is knitted). Such a yarn is more absorbent than traditional absorbent yarns used in most cooling fabrics. The yarn utilized in the first side 102 is preferably Hyosung Mipan XF which has a wicking rate and a wicking distance at least twice that of cotton of equivalent density as tested after 2 minutes using AATCC Method 197.

Knitting Construction Detail

Dual function textile 100 is preferably constructed using a warp knit spacer machine. Further, the weight range of dual function textile 100 is preferably 100-600 g/m$^2$. The described embodiments of dual function textile 100 preferably has the following fiber content:

Option 1—Poly/Spandex Blend—62% Polyester, 28% Cooling Polyester, 10%

Spandex (may be altered to ±10% for each fiber).

Option 2—Poly/Nylon/Spandex Blend–60% Polyester, 30% Cooling Nylon, 10%

Spandex (may be altered to ±10% for each fiber).

Option 3—91% Cooling Polyester, 9% Spandex.

Option 4—91% Polyester +9% Spandex

Examples of stitch notations to produce these various options of dual function textile 100 will now be described. The notation on each bar can be modified to produce various alternatives. FIGS. 3A-3D depict the stitch notations for Bars 1-4, respectively, for first side 102 (loop side) according to Option 1. Similarly, FIGS. 4A-4D depict the stitch notations for Bars 1-4, respectively, for second side 106 according to Option 1. FIG. 3E depicts the combined stitch notation for first side 102 and FIG. 4E depicts the combined stitch notation for second side 106 according to Option 1. Finally, FIG. 5 depicts the combined stich notation for Option 1 for the entirety of dual function textile 100. In the described options, the front and back bars share the same end of the yarn.

Option 1—Warp Knit Spacer-Poly/Spandex Blend—90% Polyester, 10% Spandex (30% Cooling Polyester)

First side 102 for Option 1

Figure 3A:
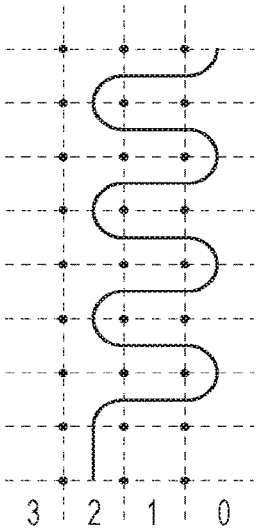
FIGS. 3A-3E depict an exemplary stitch notation for a first side of the dual function absorbing and cooling textile.
Figure 3B:
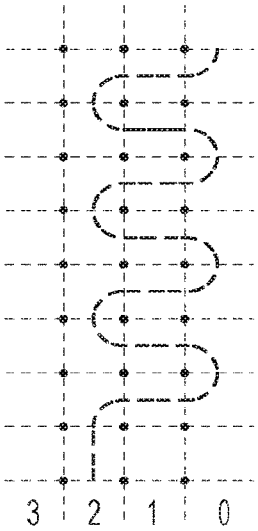
Figure 3C:
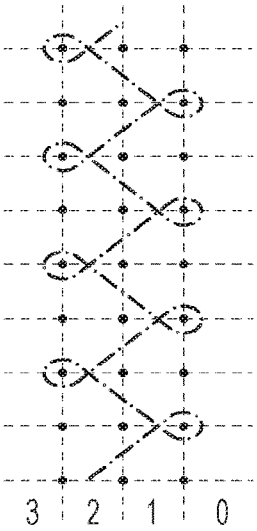
Figure 3D:
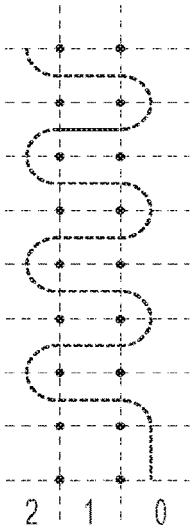
Figure 3E:
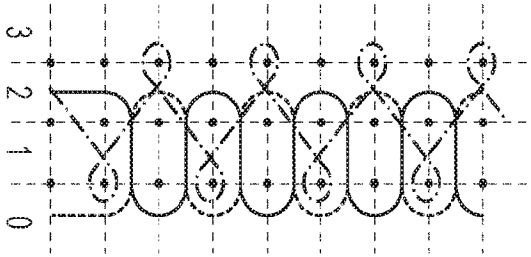

- FIG. 3A—Bar 1: 2-2/0-0 (50D/72F polyester)—absorbent yarn
- FIG. 3B—Bar 2: 2-2/0-0 (50D/72F polyester)—absorbent yarn
- FIG. 3C—Bar 3: 1-0/2-3 (50D/72F cooling polyester)—cooling yarn such as ASKIN
- FIG. 3D—Bar 4: 0-0/2-2 (70D Spandex)—elastomeric yarn Second side 106 for Option 1

Figure 4A:
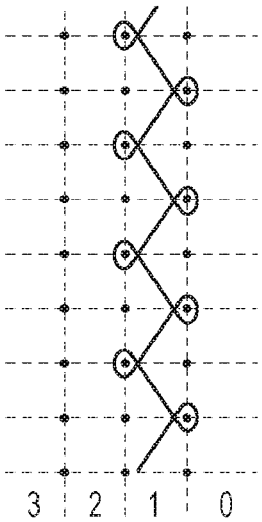
FIGS. 4A-4E depict an exemplary stitch notation for a second (opposing) side of the dual functioning absorbing and cooling textile.
Figure 5:
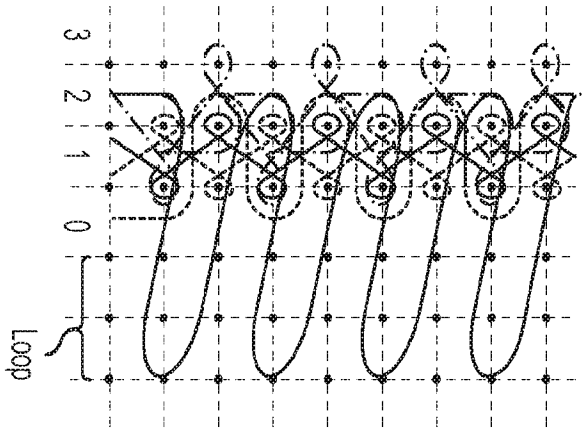
FIG. 5 depicts the combined stitch notation for the first side and the second side combined.

FIG. 4A—Bar 1: 1-0/1-2 (50D/72F polyester)—absorbent yarn

Figure 4B:
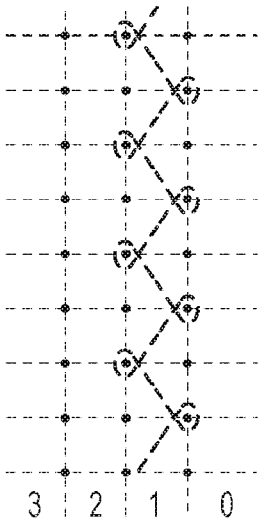

FIG. 4B—Bar 2: 1-0/1-2 (50D/72F polyester)—absorbent yarn

Figure 4C:
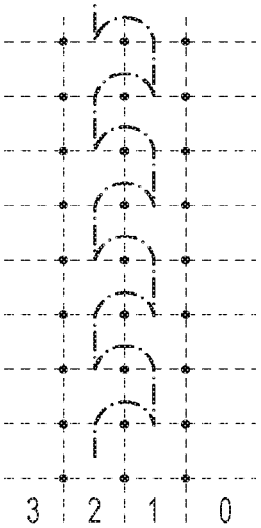
Figure 4D:
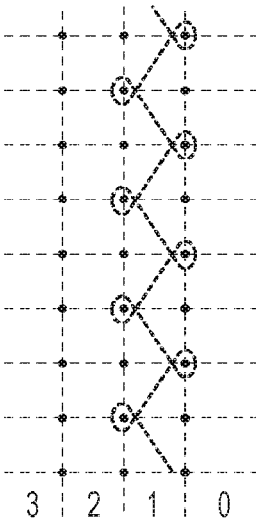
Figure 4E:
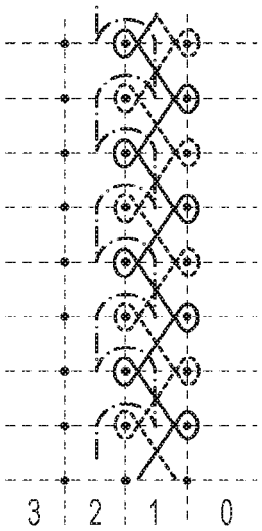

FIG. 4C—Bar 3: 2-1/1-2 (50D/72F cooling polyester)—cooling yarn such as ASKIN FIG. 4D—Bar 4: 1-2/1-0 (70D spandex)—elastomeric yarn Bar 1 for Option 1 preferably uses a 50 Denier/72 Filament Draw Textured Polyester yarn. Bar 2 for Option 1 preferably uses a 50 Denier/72 Filament Draw Textured Polyester yarn. Bar 3 for Option 1 preferably uses a 50 Denier/72 Filament Draw Textured Full Dull Cooling Polyester yarn. Bar 4 for Option 1 preferably uses a 70 Denier Spandex yarn (or equivalent elastomeric yarn).

Preferably, the dual function textile produced according to Option 1 has a course count of 50-56 courses/inch and a wales count of 33-39 wales/inch on the second side 106.

In addition to the construction for Option 1 detailed above, described below are various stitch constructions for alternate embodiments of dual function textile 100:

Option 2—Warp Knit Spacer- Poly/Nylon/Spandex Blend—60% Polyester, 30% Nylon, 10% Spandex (30% Cooling Nylon)

First side 102 for Option 2

Bar 1: 2-2/0-0 (50D/72F polyester)—absorbent yam

Bar 2: 2-2/0-0 (50D/72F polyester)—absorbent yam

Bar 3: 1-0/2-3 (50D cooling nylon)—cooling yarn such as AQUA-X

Bar 4: 0-0/2-2 (70D spandex)—elastomeric yarn

Second side 106 for Option 2

Bar 1: 1-0/1-2 (50D/72F polyester)—absorbent yam

Bar 2: 1-0/1-2 (50D/72F polyester)—absorbent yam

Bar 3: 2-1/1-2 (50D cooling nylon)—cooling yarn such as AQUA-X

Bar 4: 1-2/1-0 (70D spandex)—absorbent yarn

Bar 1 for Option 2 preferably uses a 50 Denier/72 Filament Draw Textured Polyester yarn. Bar 2 for Option 2 preferably uses a 50 Denier/72 Filament Draw Textured Polyester yarn. Bar 3 for Option 2 preferably uses a 50 Denier/72 Filament Draw Textured Full Dull Cooling Nylon yam. Bar 4 for Option 2 preferably uses a 70 Denier Spandex yam (or equivalent elastomeric yarn).

Option 3—Warp knit Spacer—90% Polyester+10% Spandex (90% Cooling polyester)

First side 102 for Option 3

Bar 1: 2-2/0-0 (50D/72F cooling polyester)—cooling yarn such as ASKIN

Bar 2: 2-2/0-0 (50D/72F cooling polyester)—cooling yarn such as ASKIN

Bar 3: 1-0/2-3 (50D/72F cooling polyester)—cooling yarn such as ASKIN

Bar 4: 0-0/2-2 (70D spandex)—elastomeric yarn

Second side 106 for Option 3

Bar 1: 1-0/1-2 (50D/72F cooling polyester)—cooling yarn such as ASKIN

Bar 2: 1-0/1-2 (50D/72F cooling polyester)—cooling yarn such as ASKIN

Bar 3: 2-1/1-2 (50D/72F cooling polyester)—cooling yarn such as ASKIN

Bar 4: 1-2/1-0 (70D spandex)—elastomeric yarn

Bars 1-3 for Option 3 preferably uses a 50 Denier/72 Filament Draw Textured Full Dull Cooling Polyester yam. Bar 4 for Option 3 preferably uses a 70 Denier Spandex (or equivalent elastomeric yarn).

Option 4—Warp knit Spacer—90% Polyester/Nylon+10% Spandex

First side 102 for Option 4

Bar 1: 2-2/0-0 (Absorbent and/or Cooling Yarn)

Bar 2: 2-2/0-0 (Absorbent and/or Cooling Yarn)

Bar 3: 1-0/2-3 (Absorbent and/or Cooling Yarn)

Bar 4: 0-0/2-2 (Elastomeric Yarn)

Second side 106 for Option 4

Bar 1: 1-0/1-2 (Absorbent and/or Cooling Yarn)

Bar 2: 1-0/1-2 (Absorbent and/or Cooling Yarn)

Bar 3: 2-1/1-2 (Absorbent and/or Cooling Yarn)

Bar 4: 1-2/1-0 (Elastomeric Yarn)

As can be seen from Options 1-4 above, the four bar warp knit spacer construction for producing dual function textile 100 generally comprises an absorbent yarn on Bars 1 and 2, a cooling yarn on Bar 3, and an elastomeric yarn on Bar 4. This ensures that the absorbent yarns form the loops on first side 102 which absorb moisture from skin surface 104. Further, the cooling yarn on Bar 3 helps in wicking and evaporation of moisture from the absorbent yarns. Finally, the elastomeric yarn used on Bar 4 (e.g., spandex) ensures that dual function textile 100 has drape and stretch properties.

Additional Performance Yarn

In some embodiments, other performance yarns can be used in dual function textile 100. Specifically, for the yarns listed in Bars 1-4 in Options 1-4, other evaporative yarns with additional performance properties can be added, blended, twisted with the evaporative yarns (e.g., the 50D/72F cooling polyester) for intensifying the cooling effect. These yarns could be but not limited to the following:

Mineral containing—Mineral-embedded yarns that contain mica, jade, coconut shell, volcanic ash, graphene, etc. could be added to provide a cool touch and increased evaporative performance. Mineral yarn has greater surface area due to having exposed particles which provides added evaporation power. An example of this type of yarn would be 37.5 polyester and 37.5 nylon.

Absorbent yarns—Highly absorbent yarns such as bi-component synthetic, alternative modified cross-section synthetic yarn, cellulosic, and non-cellulosic blended yarns can be used. This can include both filament and spun yarn and yarn combinations thereof.

Phase Change—Phase change yarns such as "Outlast" polyester and "Outlast" nylon, cellulosic, and non-cellulosic blended fiber can be added to the present invention to provide added cooling power and cooling touch.

Additional Performance Yam Denier/Filament Ranges:

Bars 1 to 3—Absorbent or cooling polyester or nylon yarns

Denier range—10 Denier—200 Denier

Filament range—10 filament—400 filaments

Bar 4—Elastomeric yarn (Spandex or other Elastomeric yarn)

Denier range–10 Denier—340 Denier

Absorbent Yarn Details (Bars 1 and 2)

The following provides a description of various absorbent yams which can be used in the production of dual function textile 100. These absorbent yams are used to create the loops on the first side 102 of dual function textile 100 which absorbs moisture from skin surface 104. The absorbent yarns also help to retain moisture in dual function textile 100 when wetted which aids in cooling as already has been described.

A first type of absorbent yams are Microdenier. Specifically Microdenier are yarns measuring less than one (1)

denier per filament (dpf). An example of a Microdenier is 50 Denier/72 Filaments where the Denier (50) divided by the Filaments (72) is less than 1. In addition, multifilament yarns which contain a denier per filament ratio of 1.2 dpf or less would also be possible to use in this invention. Microdenier may be used on either Bars 1-3 during construction of dual function textile 100.

Conjugate Yam (Highly Absorbent Bi-component Polyester/Nylon) yarns can also be used in Bars 1-3 preferably to impart extra absorbent features to the invention. Conjugate yarns undergo a process in dyeing that dissolves a binder and allows the yarn to split, creating a pie-like cross-section. This cross-section allows for greater moisture retention than typical synthetic fibers.

Nanofront synthetic yarn technology produced by Teijin can also be used in Bars 1-3 preferably to impart extra absorbent features to dual function textile 100. Using this technology, it is possible to have a fiber diameter of 700 nanometers which is $1/7{,}500^{th}$ the thickness of human hair. Currently this yarn is polyester based.

Avra yarn technology produced by Eastman is a fiber that can provide additional moisture management and absorbency performance and can be used in Bars 1-3.

Preferably, all of the absorbent yarns used in dual function textile 100 (Bars 1-3) have the following properties. First, the absorbent yarns provide wicking and moisture management properties through their ability to move moisture from first side 102 to second side 106 to expedite evaporation.

Also, these yarns can provide "cool touch." Cool touch is tested by Q-max testing. Preferably, dual function fabric 100 has a Q-max is greater than 0.130 W/cm$^2$ on second side 106 that indicates cool touch effect based on normal industry standards for cool touch claims for polyester based products. Preferably, a Q-Max of the second side 106 when wetted (Option 1—0.442 W/cm$^2$) is at least twice a Q-Max of the second side 106 when dry (Option 1—0.163 W/cm$^2$). Also, a Q-Max of second side 106 (Option 1—0.442 W/cm$^2$) when wetted is at least twice the Q-Max of the first side 102 when wetted (Option 1—0.157 W/cm$^2$).

The above-described absorbent yarns also provide quick absorption of moisture, allowing moisture to soak into the fabric in under 3 seconds when tested according to AATCC 79.

Cooling Yarn Details (Bars 1-3)

A cooling yarn is a synthetic yarn that wicks moisture. Cooling Evaporative Yarns, like ASKIN and MIPAN AQUA-X, have a modified cross-section capable to provide quick absorption, fast drying, and capillary wicking action to the dual function textile 100. These cooling fibers have embedded minerals or particles such as mica, titanium dioxide, or jade which allow the dual function textile 100 to have a Q-max of 0.130 or higher on second side 106. Furthermore, the modified cross-section cooling evaporative yarn adds opacity and UV protection. Therefore, the use of these yarns enables more evaporative cooling power than generic polyester.

Elastomeric Yarn Details (Bar 4)

As already described, Bar 4 preferably utilizes an elastomeric yarn in embodiments of dual function textile 100. The elastomeric yarn provides functional stretch and recovery properties. Specifically, an elastomer is used in the fabric to prevent excessive growth. Specifically, dual function textile 100 preferably contains 10% or less of spandex yarn so that the elastomer will assist to maintain 10% growth or less after 60 seconds when tested with ASTM D2594.

Additional Benefits of dual function textile 100

In use, dual function textile 100 can have a temperature decrease of 30 degrees below average core body temperature (98.6F) when wet activated. Further, dual function textile 100 has over a 60% increase in conductive Cooling Power measured in W/m$^2$ when compared against the current microfiber cooling towel and over a 50% increase in conductive Cooling Power over PVA and Cotton towels.

Dual function textile 100 has a duration of cooling of over 11.0 hours depending on external humidity/temperature. This is supported by an independent study in a controlled laboratory environment. The report validated that the dual function textile 100 stayed over 50% wet to 11.1 hours which means it can hold water inside the towel for longer and thereby produce evaporative cooling longer than a traditional microfiber cooling textiles.

The Wet-Pick-Up Percentage of dual function textile 100 is also over four times its weight which is significantly higher than traditional microfiber cooling textile options in the market. Dual function textile 100 also has absorbing ability from first side 102 and cool touch on the opposing side (second side 106) when placed against the skin.

Additional testing has demonstrated that the Wet-Pick-Up Percentage (WPU %) for one embodiment of the dual function textile 100 to be 489% or 4.9 times the weight of the fabric. Furthermore, testing on an alternate embodiment of the textile has a WPU % of 532% or 5.3 times the weight of fabric. This is an increase over the traditional Microfiber cooling towels that historically reach a maximum of 157% WPU % or 1.57 times the weight of fabric.

The combination of the yarns in the dual function textile 100 on the loop absorbing side (first side 102) plus the evaporative yarns used in the cooling face side (second side 106) create a higher conductive cooling power measured in Watts/m$^2$ than both polyvinyl alcohol (PVA) and 100% woven cotton towels. Specifically, two separate testing reports have shown that the dual function textile 100 described herein generates 23,483 Watts/m$^2$ (415 g/m$^2$ embodiment of Option 4) and 22,709 Watts/m$^2$ (395 g/m$^2$ embodiment of Option 1), respectively, while PVA and Cotton towels generate only 15,011 and 14,967 Watts/m$^2$ respectively. This therefore shows the dual function textile 100 of the present invention generates approximately 56% to 51% higher watts of cooling energy than both PVA and Cotton towels as measured by testing through Vartest Laboratories using the modified ASTM F1868 Method entitled "Standard Test Method for Thermal and Evaporative Resistance of Clothing Materials Using a Sweating Hot Plate."

The dual function textile 100 can also be treated with Antimicrobial chemistry or special yarns added to inhibit microbe growth thereby making it re-useable without stinking. No chemicals are required to be added to dual function textile 100 to impart cooling ability.

Further, the dual function textile 100 made according to any of the described embodiments, dries soft, is reusable, and is machine washable.

Finishing Practices

In addition to normal textile finishing practices, an embodiment of the present invention includes applying extra finishing practices before or after construction of dual function absorbing and cooling textile 100 which impart added cooling power, duration, temperatures and other cooling performance properties when the dual function absorbing and cooling textile 100 is wetted to activate. The following provides examples of additional finishing practices suitable for use with dual function absorbing and cooling textile 100. Combinations of the following methods may also be employed.

Figure 6:
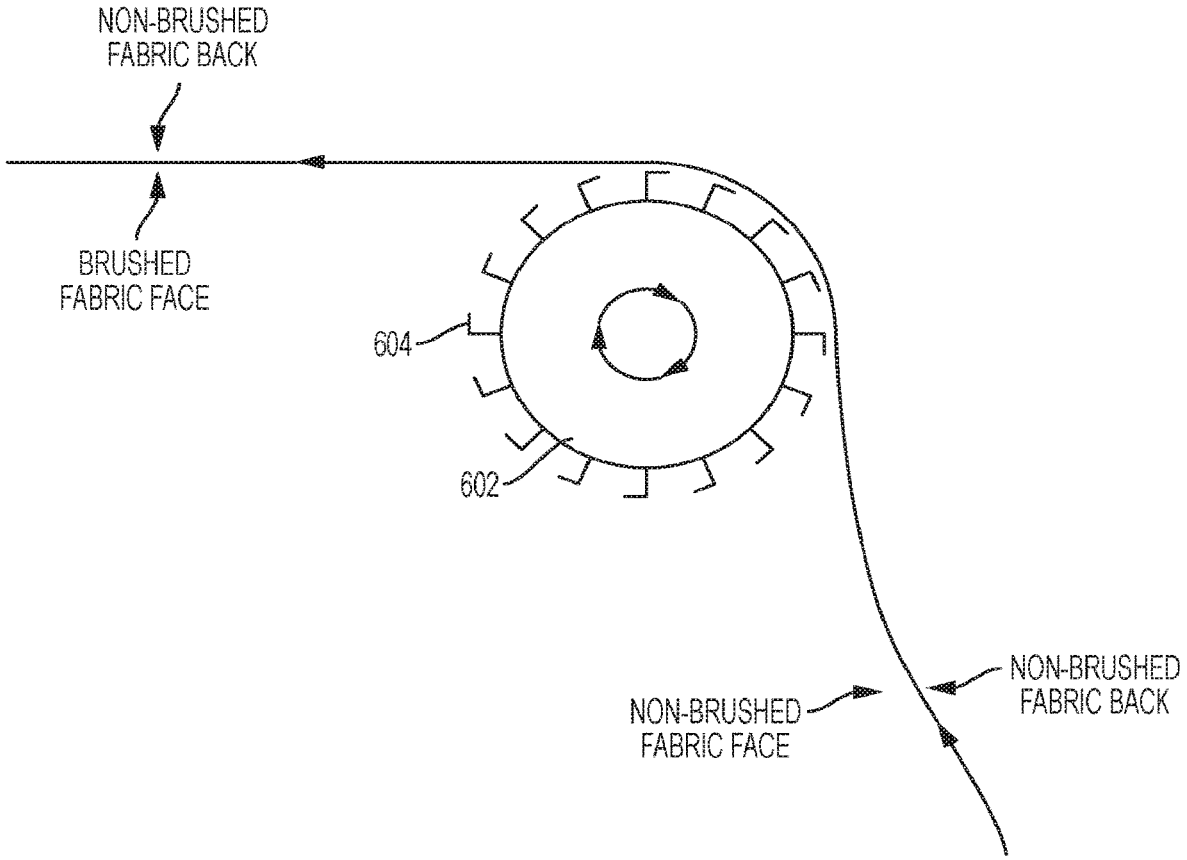
FIG. 6 depicts a brushing process.

Brushing—Brushing, using methods such as pin brushing or less obtrusive ceramic paper brushing, provides pile height to the cooling fabric. This pile height provides a softer hand feel aesthetically and added absorbent ability. Additionally, added surface area for water evaporation helps speed the rate of evaporation. A diagram of a pin-type brushing machine is depicted in FIG. 6. As shown, one face (side 106) of the dual function absorbing and cooling textile 100 is fed over pin brusher 602 which rotates in a direction opposite to the direction that dual function absorbing and cooling textile 100 is fed. As dual function absorbing and cooling textile 100 passes over pins 604, the pins slowly brush the surface of second side 106, leaving the back unscathed. In some embodiments, both sides of dual function textile 100 can be brushed.

Figure 7:
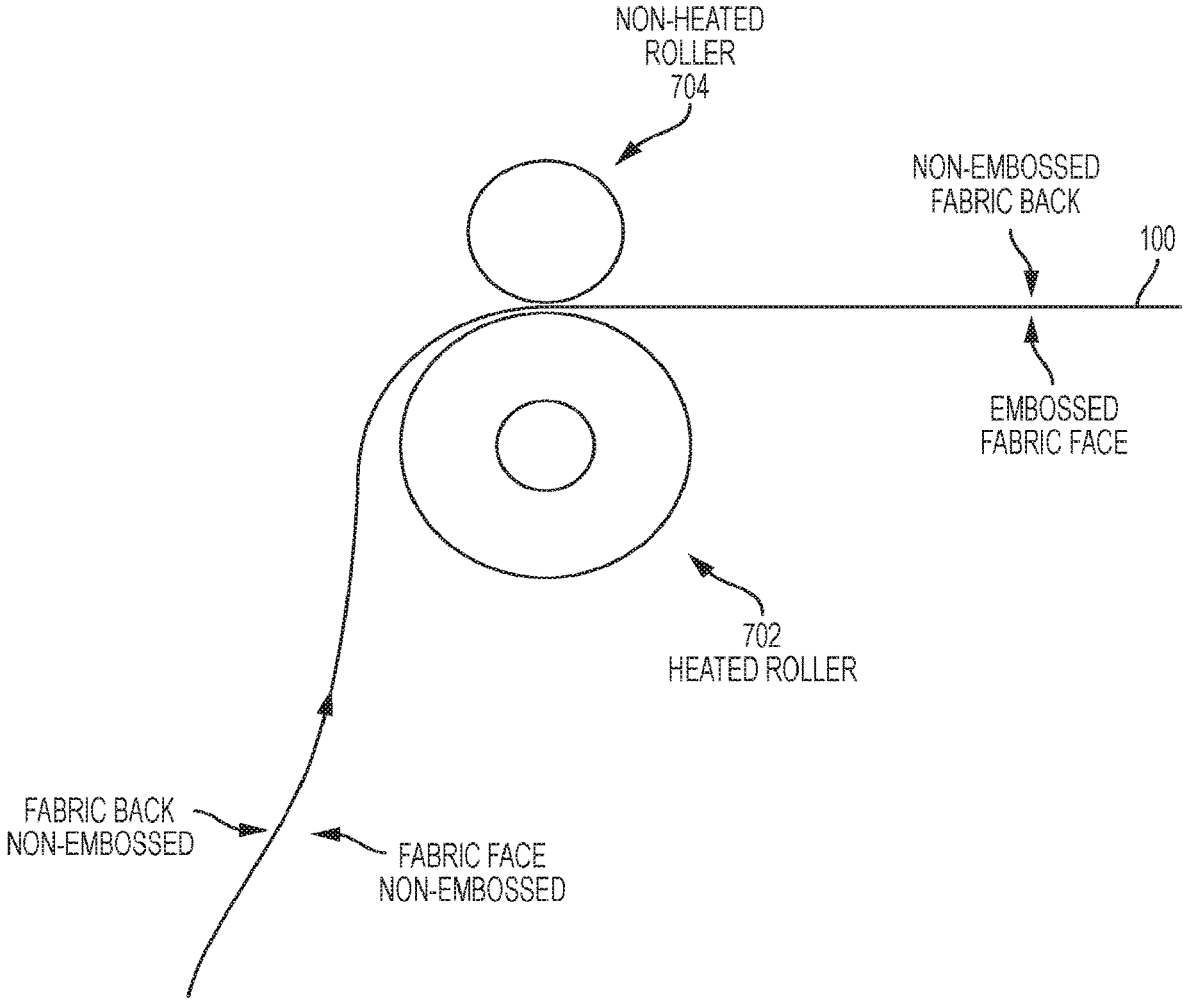
FIG. 7 depicts an embossing process.

Embossing—Embossing creates a reorientation of the fibers on the fabric surface. This finishing method is used to add surface area by flattening the yarn surface. This added surface area allows for a higher evaporation rate which thereby creates additional cooling properties and a higher level of evaporation. A diagram of an embossing machine and process is depicted in FIG. 7. Here, the dual function absorbing and cooling textile 100 is fed between heated roller 702 and non-heated roller 704. The surface of heated roller 702 generally contains the pattern which is to appear on the final embossed fabric (second side 106). In other embodiments, the fabric may be reversed if both sides of dual function absorbing and cooling textile 100 are to be embossed.

Figure 8:
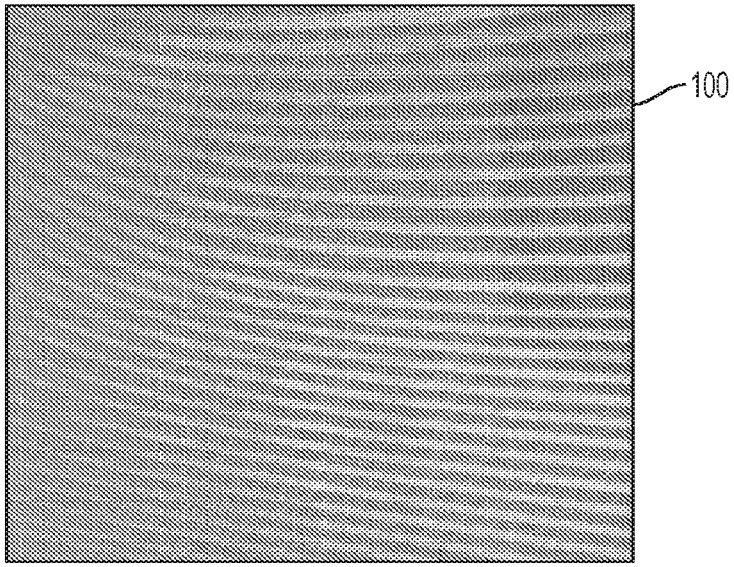
FIG. 8 depicts an image of a brushed and embossed cooling fabric.

Brushed+Embossed—Using a combination of brushing and embossing can impart added cooling properties to the cooling fabric. Brushing and Embossed performance benefits are both described above. A sample of textured dual function textile 100 is depicted in FIG. 8 which has been both brushed and embossed.

Chemical Updates

Chemicals can also be used to impart added cooling power, duration, and lower temperatures to the wet to activate dual function absorbing and cooling textile 100. The below is a summary of additional finishing practices. A combination of these methods can also be used with dual function textile 100.

Cooling print—Printed chemistries using conventional and non-conventional printing techniques can be used to add Hydrophobic, Hydrophilic, Phase Change, Minerals (particles), etc., chemistries to the cooling textile 100 surface. These chemistries impart added cooling power, duration, and lower temperatures when wetted to activate.

Cooling gel—Cooling gels of proprietary composition and printed or coated on to dual function textile 100 can impart added cooling properties to dual function textile 100.

Cooling finish—Cooling chemistries such as Xylitol, Erythritol, and other cooling finishes can be added to dual function absorbing and dual function textile 100 to impart added cooling properties to dual function textile 100 when wetted to activate, and secondly in a dry state.

Fabric Construction & Yarn Positions

Circular Knit Spacer—A similar layering effect depicted in FIG. 1 may also be achieved using a circular knit spacer. A circular knit spacer machine has the added capability of inserting additional yarns such as a mono-filament yarn to provided added thickness to the material. This added thickness created by yarns such as monofilament yarn can be substituted or combined intermittently with conjugate yarn while the outside yarns used can be highly evaporative yarns or any previously described yarns.

Flat bed knitting—A similar layering effect depicted in FIG. 1 can also be achieved using a flat knitting machine. A flat knitting machine is very flexible, allowing complex stitch designs, shaped knitting and precise width adjustment. The two largest manufacturers of industrial flat knitting machines are Stoll of Germany, and Shima Seiki of Japan.

The present invention has been described with respect to various examples. Nevertheless, it is to be understood that various modifications may be made without departing from the spirit and scope of the invention as described by the following claims.

The invention claimed is:

1. A two-sided absorbing and cooling textile comprising:

an absorbent side formed by two separate yarns comprising a first yarn and a second yarn, wherein the first yarn and the second yarn are located on separate but adjacent knitting bars during construction of the two-sided absorbing and cooling textile, and wherein a pile height of the absorbent side is greater than 0.2 millimeter for absorbing moisture from a skin surface; and a cooling side formed by four separate yarns comprising the first yarn, the second yarn, an evaporative cooling yarn, and an elastomeric yarn, wherein the cooling side is configured to transport the absorbed moisture from the absorbent side in order to expose the absorbed moisture to the cooling side for evaporation.

2. The two-sided absorbing and cooling textile of claim 1, wherein the two-sided absorbing and cooling textile cools the skin surface on the cooling side by up to 20° F. and up to 40° F. over core body temperature when the two-sided absorbing and cooling textile is wetted.

3. The two-sided absorbing and cooling textile of claim 1, wherein the two-sided absorbing and cooling textile cools the skin surface for a period of over 4 hours when wetted.

4. The two-sided absorbing and cooling textile of claim 1, wherein the two-sided absorbing and cooling textile is constructed using a warp knit spacer construction.

5. The two-sided absorbing and cooling textile of claim 1, wherein the two-sided absorbing and cooling textile is constructed using a warp knit spacer machine.

6. The two-sided absorbing and cooling textile of claim 1, wherein the first yarn is Microdenier, Microfiber, Conjugated Bi-component Poly/Nylon, Cooling Polyester, or Cooling Nylon.

7. The two-sided absorbing and cooling textile of claim 1, wherein the second yarn is Microdenier, Microfiber, Conjugated Bi-component Poly/Nylon, Cooling Polyester, or Cooling Nylon.

8. The two-sided absorbing and cooling textile of claim 1, wherein the evaporative cooling yarn is an evaporative and UV-protective yarn.

9. The two-sided absorbing and cooling textile of claim 1, wherein the two-sided absorbing and cooling textile has a weight of 100-600 g/m$^2$.

10. The two-sided absorbing and cooling textile of claim 1, wherein the elastomeric yarn is spandex.

11. A two-sided absorbing and cooling textile produced using a warp knit spacer construction comprising:

an absorbing side, wherein a first bar on the absorbing side uses a 2-2/0-0 stitch notation on a first course using a first yarn, wherein a second bar on the absorbing side uses a 2-2/0-0 stitch notation on the first course using a second yarn, wherein a third bar on the absorbing side uses a 1-0/2-3 stitch notation on the first course using a third yarn, wherein a fourth bar the absorbing side uses a 0-0/2-2 stitch notation on the first course using a fourth yarn; and a cooling side, wherein a first bar on the cooling side uses a 1-0/1-2 stitch notation the first course simultaneously using the first yarn from the first bar on the absorbing side, wherein a second bar on the cooling side uses a 1-0/1-2 stitch notation on the first course simultaneously using the second yarn from the second bar on the absorbing side, wherein a third bar on the cooling side uses a 2-1/1-2 stitch notation on the first course simultaneously using the third yarn from the third bar on the absorbing side, wherein a fourth bar the cooling side uses a 1-2/1-0 stitch notation on the first course simultaneously using the fourth yarn from the fourth bar on the absorbing side, wherein the first yarn is a microdenier polyester yarn, wherein the second yarn is a microdenier polyester yarn, wherein the third yarn is a cooling polyester yarn, and wherein the fourth yarn is an elastomeric yarn.

12. The two-sided absorbing and cooling textile according to claim 11, wherein the first yarn is a 50 Denier/72 Filaments draw textured yarn.

13. The two-sided absorbing and cooling textile according to claim 12, wherein the second yarn is a 50 Denier/72 Filaments draw textured yarn.

14. The two-sided absorbing and cooling textile according to claim 13, wherein the fourth yarn is spandex.

15. A two-sided absorbing and cooling textile produced using a warp knit spacer construction comprising:

an absorbing side; and a cooling side, wherein a first bar on the absorbing side uses a 2-2/0-0 stitch notation on a first course using microfiber polyester yarn, wherein a first bar on the cooling side uses a 1-0/1-2 stitch notation on the first course using microfiber polyester yarn, wherein a second bar on the absorbing side uses a 2-2/0-0 stitch notation on the first course using microfiber polyester yarn, wherein a second bar on the cooling side uses a 1-0/1-2 stitch notation on the first course using microfiber polyester yarn, wherein a third bar on the absorbing side uses a 1-0/2-3 stitch notation on the first course using evaporative cooling polyester yarn, wherein a third bar on the cooling side uses a 2-1/1-2 stitch notation on the first course using evaporative cooling polyester yarn, wherein a fourth bar on the absorbing side uses a 0-0/2-2 stitch notation on the first course using elastomeric yarn, and wherein a fourth bar on the cooling side uses a 1-2/1-0 stitch notation on the first course using elastomeric yarn.

16. A two-sided absorbing and cooling textile produced using a warp knit spacer construction comprising:

an absorbing side; and a cooling side, wherein a first bar on the absorbing side uses a 2-2/0-0 stitch notation on a first course using microfiber polyester yarn, wherein a first bar on the cooling side uses a 1-0/1-2 stitch notation on the first course using microfiber polyester yarn, wherein a second bar on the absorbing side uses a 2-2/0-0 stitch notation on the first course using microfiber polyester yarn, wherein a second bar on the cooling side uses a 1-0/1-2 stitch notation on the first course using microfiber polyester yarn, wherein a third bar on the absorbing side uses a 1-0/2-3 stitch notation on the first course using evaporative cooling nylon yarn, wherein a third bar on the cooling side uses a 2-1/1-2 stitch notation on the first course using evaporative cooling nylon yarn, wherein a fourth bar on the absorbing side uses a 0-0/2-2 stitch notation on the first course using elastomeric yarn, and wherein a fourth bar on the cooling side uses a 1-2/1-0 stitch notation on the first course using elastomeric yarn.

17. A two-sided absorbing and cooling textile produced using a warp knit spacer construction comprising:

an absorbing side; and a cooling side, wherein a first bar on the absorbing side uses a 2-2/0-0 stitch notation on a first course using evaporative cooling polyester yarn, wherein a first bar on the cooling side uses a 1-0/1-2 stitch notation on the first course using evaporative cooling polyester yarn, wherein a second bar on the absorbing side uses a 2-2/0-0 stitch notation on the first course using evaporative cooling polyester yarn, wherein a second bar on the cooling side uses a 1-0/1-2 stitch notation on the first course using evaporative cooling polyester yarn, wherein a third bar on the absorbing side uses a 1-0/2-3 stitch notation on the first course using evaporative cooling polyester yarn, wherein a third bar on the cooling side uses a 2-1/1-2 stitch notation on the first course using evaporative cooling polyester yarn, wherein a fourth bar on the absorbing side uses a 0-0/2-2 stitch notation on the first course using spandex yarn, and wherein a fourth bar on the cooling side uses a 1-2/1-0 stitch notation on the first course using spandex yarn.

18. A two-sided absorbing and cooling textile produced using a warp knit spacer construction comprising:

an absorbing side; and a cooling side, wherein a first bar on the absorbing side uses a 2-2/0-0 stitch notation on a first course using evaporative cooling polyester yarn, wherein a first bar on the cooling side uses a 1-0/2-3 stitch notation on the first course using evaporative cooling polyester yarn, wherein a second bar on the absorbing side uses a 2-2/0-0 stitch notation on the first course using evaporative cooling polyester yarn, wherein a second bar on the cooling side uses a 1-0/2-3 stitch notation on the first course using evaporative cooling polyester yarn, wherein a third bar on the absorbing side uses a 1-0/2-3 stitch notation on the first course using evaporative cooling polyester yarn, wherein a third bar on the cooling side uses a 2-1/1-2 stitch notation on the first course using evaporative cooling polyester yarn, wherein a fourth bar on the absorbing side uses a 0-0/2-2 stitch notation on the first course using spandex yarn, and wherein a fourth bar on the cooling side uses a 1-2/1-0 stitch notation on the first course using spandex yarn.

19. The two-sided absorbing and cooling textile of claim 1, wherein the absorbing side has a pile height of 2-3 mm.

20. The two-sided absorbing and cooling textile of claim 1, wherein the absorbing side has a pile height of 0.5-10 mm.

21. A two-sided absorbing and cooling textile comprising:

an absorbent side; and a cooling side opposite the absorbent side;

wherein a pile height of the absorbent side is proportional to a duration of conductive cooling of the two-sided absorbing and cooling textile, and wherein a Q-Max of the cooling side when wetted is at least twice a Q-Max of the cooling side when dry.

22. The two-sided absorbing and cooling textile of claim 21, wherein the Q-Max of cooling side when wetted is at least twice a Q-Max of the absorbent side when wetted.

* * * * *